US006154142A

United States Patent [19]

Kosugi et al.

[11] Patent Number: 6,154,142

[45] Date of Patent: Nov. 28, 2000

[54] FIRE SENSOR AND FIRE DETECTING METHOD

[75] Inventors: Naoki Kosugi; Masayuki Ito, both of Tokyo, Japan

[73] Assignee: Hochiki Corporation, Tokyo, Japan

[21] Appl. No.: 09/427,072

[22] Filed: Oct. 26, 1999

[30] Foreign Application Priority Data

Oct. 30, 1998 [JP] Japan ..... 10-310148

[51] Int. Cl.[7] ..... G08B 17/00

[52] U.S. Cl. ..... 340/589; 340/577; 340/584; 340/628

[58] Field of Search ..... 340/577, 578, 340/579, 584, 589, 628, 629, 630

[56] References Cited

U.S. PATENT DOCUMENTS 4,420,746 12/1983 Malinowski ..... 340/574
4,922,230 5/1990 Ohtani et al. ..... 340/589
5,254,975 10/1993 Torikoshi ..... 340/589
5,627,514 5/1997 Morita ..... 340/589

FOREIGN PATENT DOCUMENTS 0 618 555 A2 10/1994 European Pat. Off. ..... G08B 17/107
2 190 777 11/1987 United Kingdom ..... G08B 17/00
96/04631 2/1996 WIPO ..... G08B 29/18

*Primary Examiner*—Daniel J. Wu
*Attorney, Agent, or Firm*—Sughrue, Mion, Zinn, Macpeak & Seas, PLLC

[57] ABSTRACT

A temperature difference calculator portion detects temperature difference indicating the rate of temperature rise when it receives heat generated by the fire. A correction factor deciding portion decides a correction factor for a smoke signal based on an external temperature and the temperature difference. Finally, a smoke data correction portion corrects smoke data by multiplying the smoke signal detected by a smoke detector and the correction factor.

16 Claims, 9 Drawing Sheets

FIG. 6A

| | | TEMPERATURE DIFFERENCE ΔT (°C) | | | |
|---|---|---|---|---|---|
| | | BELOW 5.5°C | 5.5°C ≤ ΔT < 13.0°C | 13.0°C ≤ ΔT < 20.5°C | OVER 20.5°C |
| EXTERNAL TEMPERATURE To (°C) | BELOW 40.0°C | 1.0 | 1.0 | 1.0 | 1.0 |
| | 40.0°C ≤ To < 50.0°C | 1.0 | 1.1 | 1.2 | 1.3 |
| | 50.0°C ≤ To < 60.0°C | 1.0 | 1.2 | 1.3 | 1.4 |
| | 60.0°C ≤ To < 70.0°C | 1.0 | 1.3 | 1.4 | 1.5 |
| | 70.0°C ≤ To < 80.0°C | 1.0 | 1.0 | 1.4 | 1.5 |
| | OVER 80.0°C | 1.0 | 1.0 | 1.5 | 1.6 |

FIG. 6B

| | | TEMPERATURE DIFFERENCE ΔT (°C) | | | |
|---|---|---|---|---|---|
| | | BELOW 5.5°C | 5.5°C ≤ ΔT < 13.0°C | 13.0°C ≤ ΔT < 20.5°C | OVER 20.5°C |
| EXTERNAL TEMPERATURE To (°C) | BELOW 40.0°C | NO CORRECTION | NO CORRECTION | NO CORRECTION | NO CORRECTION |
| | 40.0°C ≤ To < 50.0°C | NO CORRECTION | 1.1 | 1.2 | 1.3 |
| | 50.0°C ≤ To < 60.0°C | NO CORRECTION | 1.2 | 1.3 | 1.4 |
| | 60.0°C ≤ To < 70.0°C | NO CORRECTION | 1.3 | 1.4 | 1.5 |
| | 70.0°C ≤ To < 80.0°C | NO CORRECTION | NO CORRECTION | 1.4 | 1.5 |
| | OVER 80.0°C | NO CORRECTION | NO CORRECTION | 1.5 | 1.6 |

FIG. 7A

| | | TEMPERATURE DIFFERENCE ΔT (°C) | | | |
|---|---|---|---|---|---|
| | | BELOW 5.5°C | 5.5°C ≤ ΔT < 13.0°C | 13.0°C ≤ ΔT < 20.5°C | OVER 20.5°C |
| EXTERNAL TEMPERATURE To (°C) | BELOW 40.0°C | NO CORRECTION | NO CORRECTION | NO CORRECTION | NO CORRECTION |
| | 40.0°C ≤ To < 50.0°C | NO CORRECTION | 28 | 29 | 30 |
| | 50.0°C ≤ To < 60.0°C | NO CORRECTION | 31 | 32 | 33 |
| | 60.0°C ≤ To < 70.0°C | NO CORRECTION | 34 | 35 | 36 |
| | 70.0°C ≤ To < 80.0°C | NO CORRECTION | NO CORRECTION | 37 | 38 |
| | OVER 80.0°C | NO CORRECTION | NO CORRECTION | 39 | 40 |

FIG. 7B

76

| ADDRESS | CORRECTION FACTOR | TEMPERATURE DIFFERENCE |
|---|---|---|
| 28 | 1.1 | 6 |
| 29 | 1.2 | 13 |
| 30 | 1.3 | 21 |
| 31 | 1.2 | 6 |
| 32 | 1.3 | 13 |
| 33 | 1.4 | 21 |
| 34 | 1.3 | 6 |
| 35 | 1.4 | 13 |
| 36 | 1.5 | 21 |
| 37 | 1.4 | 13 |
| 38 | 1.5 | 21 |
| 39 | 1.5 | 13 |
| 40 | 1.6 | 21 |

FIG. 7C

76

| ADDRESS | CORRECTION FACTOR | TEMPERATURE DIFFERENCE |
|---|---|---|
| 28 | 141 | 6 |
| 29 | 154 | 13 |
| 30 | 166 | 21 |
| 31 | 154 | 6 |
| 32 | 166 | 13 |
| 33 | 179 | 21 |
| 34 | 166 | 6 |
| 35 | 179 | 13 |
| 36 | 192 | 21 |
| 37 | 179 | 13 |
| 38 | 192 | 21 |
| 39 | 192 | 13 |
| 40 | 205 | 21 |

FIRE SENSOR AND FIRE DETECTING METHOD

BACKGROUND OF THE INVENTION

1. Field of the Invention

The present invention relates to a fire sensor and a fire detecting method for detecting a fire using both sensor signals from a temperature sensor and a smoke sensor and, more particularly, a fire sensor and a fire detecting method for detecting a fire by correcting a smoke signal according to change in the temperature situation caused by the fire.

2. Description of the Related Art

Conventionally, as the multi-sensor type fire detecting method having both functions of detecting smoke and heat generated by the fire, there is the fire detecting method set forth in U.S. Pat. No. 5,005,003.

According to the multi-sensor type fire detecting method, in the situation that the heat generated by the fire is detected by a temperature sensor and then a detected temperature is increased in excess of a certain level, a smoke detection sensitivity can be increased by lowering a threshold value, by which the fire is decided based on a smoke signal being detected by the smoke sensor, to thus detect early the fire. In contrast, if the temperature detected by the temperature sensor is less than another certain level, the smoke detection sensitivity can be decreased by increasing the threshold value of the smoke sensor to thus prevent a false alarm. However, according to the method in which the detection sensitivity for the smoke signal supplied from the smoke sensor is changed based on the detected temperature by the temperature sensor, if the temperature is increased although its temperature rise is caused gradually, e.g., if a room temperature is increased in the summer season, if a temperature is increased by the heating or the like, the detection sensitivity of the smoke sensor is increased. Therefore, the smoke, the steam, etc. other than the fire are judged erroneously as the fire, and hence it may be a cause of the non-fire alarm.

In the fire detecting method using the temperature sensor, there is a method utilizing a differential element which can detect a rate of temperature rise relative to the time and then decide the fire based on the rapid temperature rise. According to the fire detecting method utilizing the differential element, because the smoke detection sensitivity is decreased at the time of the slow temperature rise whereas the smoke detection sensitivity is increased at the time of the quick temperature rise, the fire can be detected without fail even if a smoke density is low. However, in the fire detecting method utilizing the differential element, if the hot air of the heating, etc. blows directly against the fire sensor irrespective of the low room temperature, the smoke detection sensitivity is increased due to the rapid temperature rise. Therefore, the smoke generated by the causes other than the fire is judged as the fire, and hence it may be also a cause of the non-fire alarm.

SUMMARY OF THE INVENTION

It is an object of the present invention to provide a fire sensor and a fire detecting method capable of achieving early detection of a fire and prevention of a non-fire alarm by correcting a smoke detecting characteristic which utilizes both a current temperature and a rate of temperature rise.

A fire sensor of the present invention comprises, as sensors, a smoke detecting portion for detecting a smoke signal S which changes in response to a smoke density to output it, an external temperature detecting portion for detecting an eternal temperature To of the sensor to output it, and an internal temperature detecting portion for detecting an internal temperature Ti of the sensor to output it.

Then, a temperature difference calculating portion calculates temperature difference ΔT, which indicates a rate of temperature rise when the sensor receives heat generated by a fire, between the external temperature To and the internal temperature Ti. Then, a correction factor deciding portion decides a correction factor K for the smoke signal S based on the eternal temperature To and the temperature difference ΔT. Finally, a smoke signal correcting portion corrects the smoke signal S by multiplying the smoke signal S by the correction factor K.

According to another aspect of the present invention, there is provided a fire sensor comprising, as sensors, a smoke detecting portion for detecting a smoke signal S which changes in response to a smoke density to output it, and an external temperature detecting portion for detecting an external temperature To of the sensor to output it (no internal temperature detecting portion is provided). In this case, a temperature difference calculating portion calculates temperature difference ΔT, which indicates a rate of temperature rise when the sensor receives heat generated by a fire, between the external temperature To and a pseudo output (reference temperature) which is regarded as an internal temperature of the sensor, and then a correction factor deciding portion decides a correction factor K for the smoke signal S based on the external temperature To and the temperature difference ΔT. Finally, a smoke signal correcting portion corrects the smoke signal S by multiplying the smoke signal S by the correction factor K.

According to the fire sensor of the present invention, since the correction factor K is decided by using both a current external temperature and a rate of temperature rise to correct the smoke signal S, the fire which cannot detected only by the smoke, e.g., a flaming fire in which the smoke density is low but the temperature rapidly increases can be detected without fail.

Also, since a smoke detection density can be set small in the normal circumstance in which the temperature change is small, a probability of the non-fire generation can be reduced. In particular, in the event that the sensor receives directly a hot air from a space heater in the normal circumstance, since temperature rise seldom occurs when the temperature comes up to a certain temperature, the smoke detection sensitivity can be set low. As a result, such situation is never judged as the fire even when the temperature is high.

The correction factor deciding portion divides the external temperature To and the temperature difference ΔT into a plurality of temperature ranges each having a predetermined temperature width respectively, then previously sets the correction factor K to each temperature range of the temperature difference ΔT so as to increase substantially in proportion to an increase of the temperature difference ΔT if the external temperature To belongs to a same temperature range, then previously sets the correction factor K to each temperature range of the external temperature To so as to increase substantially in proportion to rise of the external temperature To if the temperature difference ΔT belongs to a same temperature range, and then decides a previously set correction factor K based on the temperature range to which the external temperature To detected by the external temperature detecting portion belongs and the temperature range to which the temperature difference ΔT calculated by the temperature difference calculating portion belongs.

The correction factor deciding portion varies the correction factor K substantially by changing the temperature range of the external temperature To and/or the temperature range of the temperature difference ΔT while fixing the previously set correction factor K itself, otherwise varies the correction factor K itself while fixing the temperature range of the external temperature To and the temperature range of the temperature difference ΔT.

Also, the correction factor deciding portion decides the correction factor K of 1.0 and does not substantially correct the smoke signal S by the smoke signal correcting portion if the external temperature To is below a first predetermined Temperature, if the temperature difference ΔT is below a first predetermined temperature difference, or if the external temperature To is more than a second predetermined temperature and the temperature difference ΔT is less than a second predetermined temperature difference. The correction factor deciding portion has a nonvolatile memory such as an EEPROM, etc. which stores corresponding values of the correction factor K in addresses being specified by the temperature range of the external temperature To and the temperature range of the temperature difference ΔT, and decides the correction factor K by reading the correction factor K from the nonvolatile memory by using an address which is specified by the temperature range to which the external temperature To detected by the external temperature detecting portion belongs and the temperature range to which the temperature difference ΔT calculated by the temperature difference calculating portion belongs.

The external temperature detecting portion has a temperature detecting element to be exposed to an outside of the sensor. The internal temperature detecting portion has the temperature detecting element to be installed in an inside of the sensor. The temperature detecting element consists of a thermistor whose resistance value is changed according to the temperature.

The smoke detecting portion receives a scattered light emitted from a light source and scattered by the smoke, and then outputs the smoke signal S which changes in response to the smoke density. The fire sensor further comprises a transmitting portion for transmitting to a receiver the smoke signal S which is corrected by the smoke signal correcting portion. The transmitting portion transmits to the receiver the smoke signal S which is corrected by the smoke signal correcting portion based on a transmission request issued from the receiver.

Also, according to still another aspect of the present invention, there is provided a fire detecting method comprising:

a smoke detecting step of detecting a smoke signal S which changes in response to a smoke density to output it;

an external temperature detecting step of detecting an external temperature To of the sensor to output it;

an internal temperature detecting step of detecting an internal temperature Ti of the sensor to output it;

a temperature difference calculating step of calculating temperature difference ΔT between the external temperature To, which indicates a rate of temperature rise when the sensor receives heat generated by a fire, and the internal temperature Ti;

a correction factor deciding step of deciding a correction factor K for the smoke signal S based on the external temperature To and the temperature difference ΔT; and a smoke signal correcting step of correcting the smoke signal S by multiplying the smoke signal S by the correction factor K.

Also, according to a further aspect of the present invention, there is provided a fire detecting method comprising:

a smoke detecting step of detecting a smoke signal S which changes in response to a smoke density to output it; an external temperature detecting step of detecting an external temperature To of the sensor to output it;

a temperature difference calculating step of calculating temperature difference ΔT between the external temperature To, which indicates a rate of temperature rise when the sensor receives heat generated by a fire, and a pseudo output (reference temperature) which is regarded as an internal temperature Ti of the sensor;

a correction factor deciding step of deciding a correction factor K for the smoke signal S based on the external temperature To and the temperature difference Ti; and a smoke signal correcting step of correcting the smoke signal S by multiplying the smoke signal S by the correction factor K.

Details of the fire detecting method are similar in structure to those of the fire sensor.

BRIEF DESCRIPTION OF THE DRAWINGS

In the accompanying drawings:

FIGS. 6A and 6B are views showing correction factor tables employed to decide a correction factor in the present invention;

FIGS. 7A to 7C are views showing an address table and memory correction factor tables to implement the correction factor tables shown in FIG. 6;

PREFERRED EMBODIMENTS OF THE INVENTION

Preferred embodiment according to the present invention will be described referring to the accompanying drawings as follows.

Figure 1:
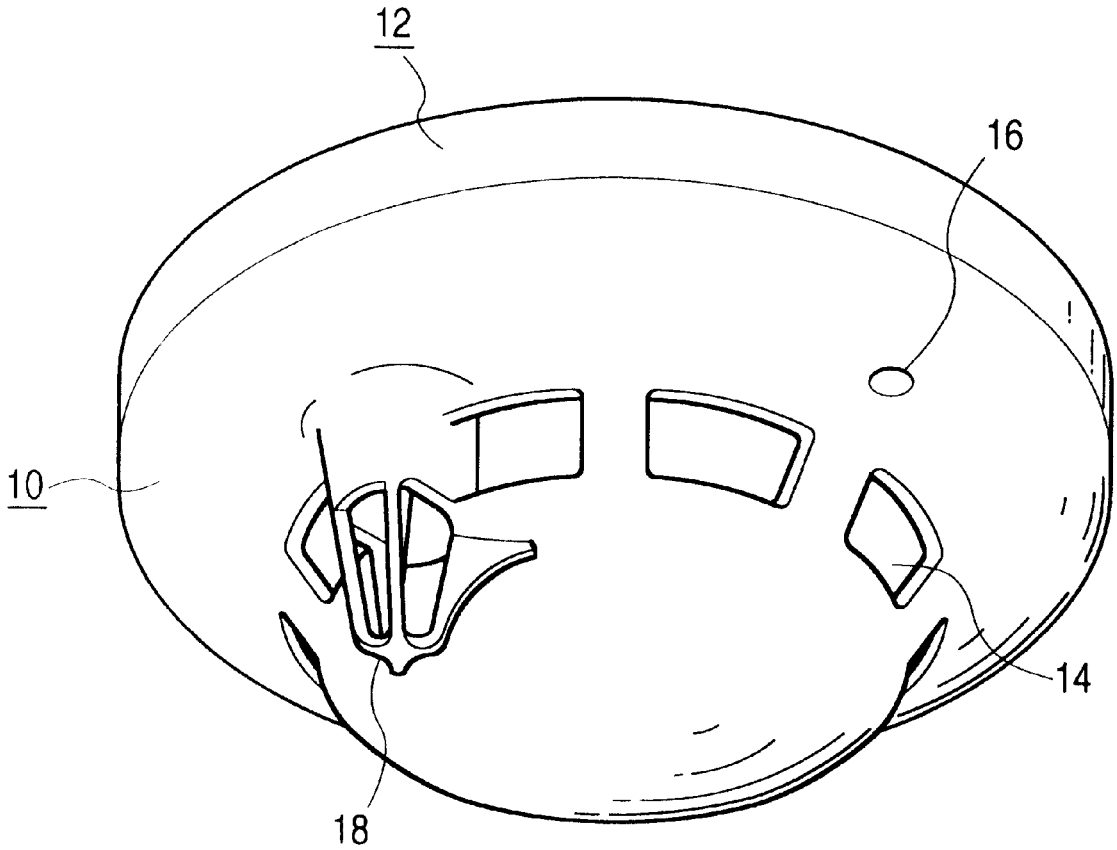
FIG. 1 is a view showing a fire sensor according to the present invention.

FIG. 1 is a view showing a situation that a fire sensor according to the present invention is fitted onto a ceiling, etc. The fire sensor according to the present invention comprises a head 10 and a base 12. The base 12 is secured to the ceiling, and the head 10 is attached to the base 12 from the lower side. The head 10 can be detachably attached to the base 12.

A plurality of smoke flow inlets 14 are opened around a detection portion which is projected from a center portion of the head 10. A sensor cover 18 formed like a cage (basket) is provided to protrude downward from the head 10. A temperature detecting element which employs a thermistor for detecting an external temperature is fitted in the sensor cover 18. Also, a working indicator 16 employing an LED is installed on the head 10.

Figure 2A:
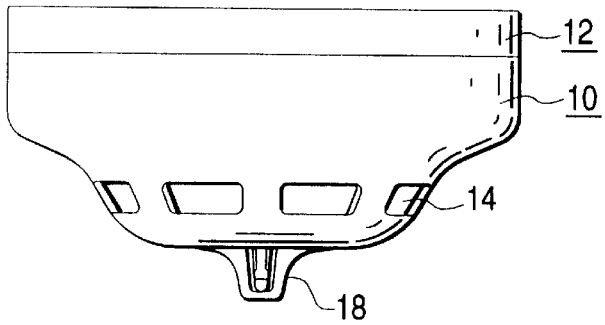
FIG. 2A is a front side view shown the fire sensor shown in FIG. 1.
Figure 2B:
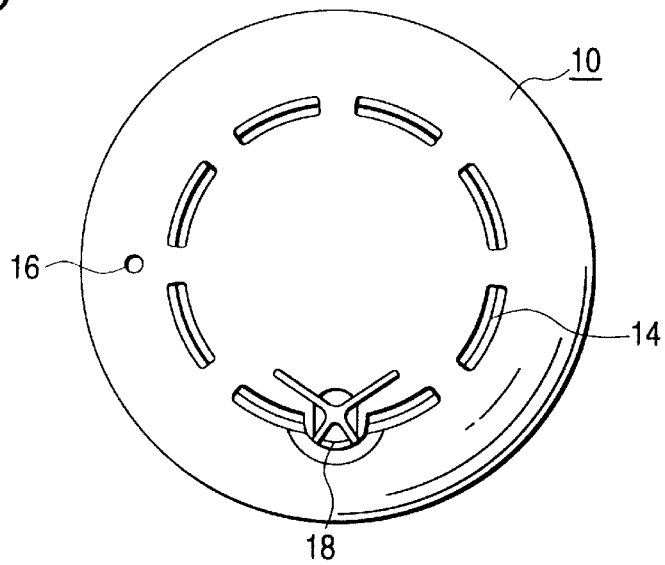
FIG. 2B is a bottom side view of the fire sensor shown in FIG. 1.
Figure 2C:
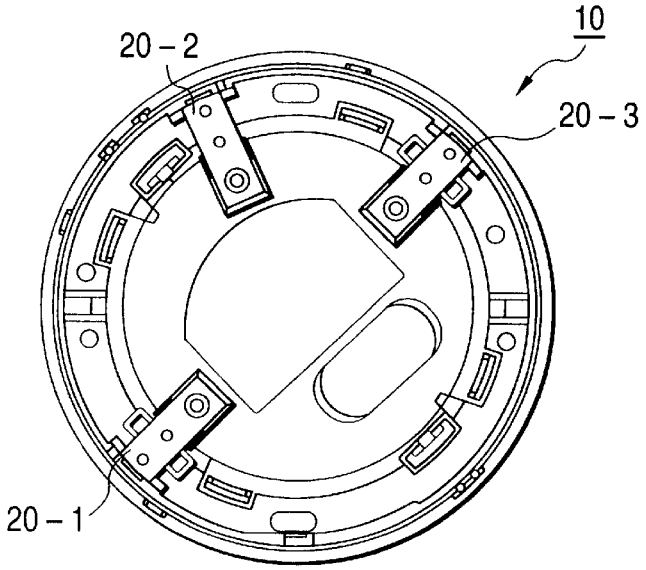
FIG. 2C is a top side view of the fire sensor shown in FIG.

FIG. 2A is a front view showing the fire sensor according to the present invention shown in FIG. 1. FIG. 2B is a bottom view showing the fire sensor viewed from the bottom side of the head 10 in FIG. 1. FIG. 2C is a plan view showing the fire sensor viewed from the top side of the head 10.

As evident from FIG. 2A, the sensor cover 18 provided to the lower side of the head 10 is protruded downward longer than the center projected portion around which the smoke flow inlets 14 are formed. Thus, the temperature detecting element such as the thermistor which is built in the sensor cover 18 can detect sufficiently effectively a hot air flow caused in the fire.

The smoke which spreads out along with the hot air flow caused in the fire can enter into the fire sensor via the smoke flow inlets 14 which are opened on the periphery of the fire sensor, so that the smoke can be detected by a built-in smoke sensor mechanism. In this case, as shown in FIG. 2B, since the smoke flow inlets 14 are formed over an entire periphery of the head 18 at a constant distance, the smoke can flow into the inside of the fire sensor from all directions and thus the smoke can be detected.

In addition, as shown in FIG. 2C, three fitting terminal jigs 20-1, 20-2, 20-3, for example, are mounted on the top of the head 10. Fitting receiver jigs are mounted on the bottom surface of the base 12 of the fire sensor so as to correspond to the fitting terminal jigs 20-1, 20-2, 20-3. The fitting terminal jigs 20-1, 20-2, 20-3 can be fitted into the fitting receiver jigs on the base 12 side by pushing the head 10 against the base 12 upward and then turning the head 10. As a result, the head 10 can be connected electrically and mechanically to the base 12.

Figure 3:
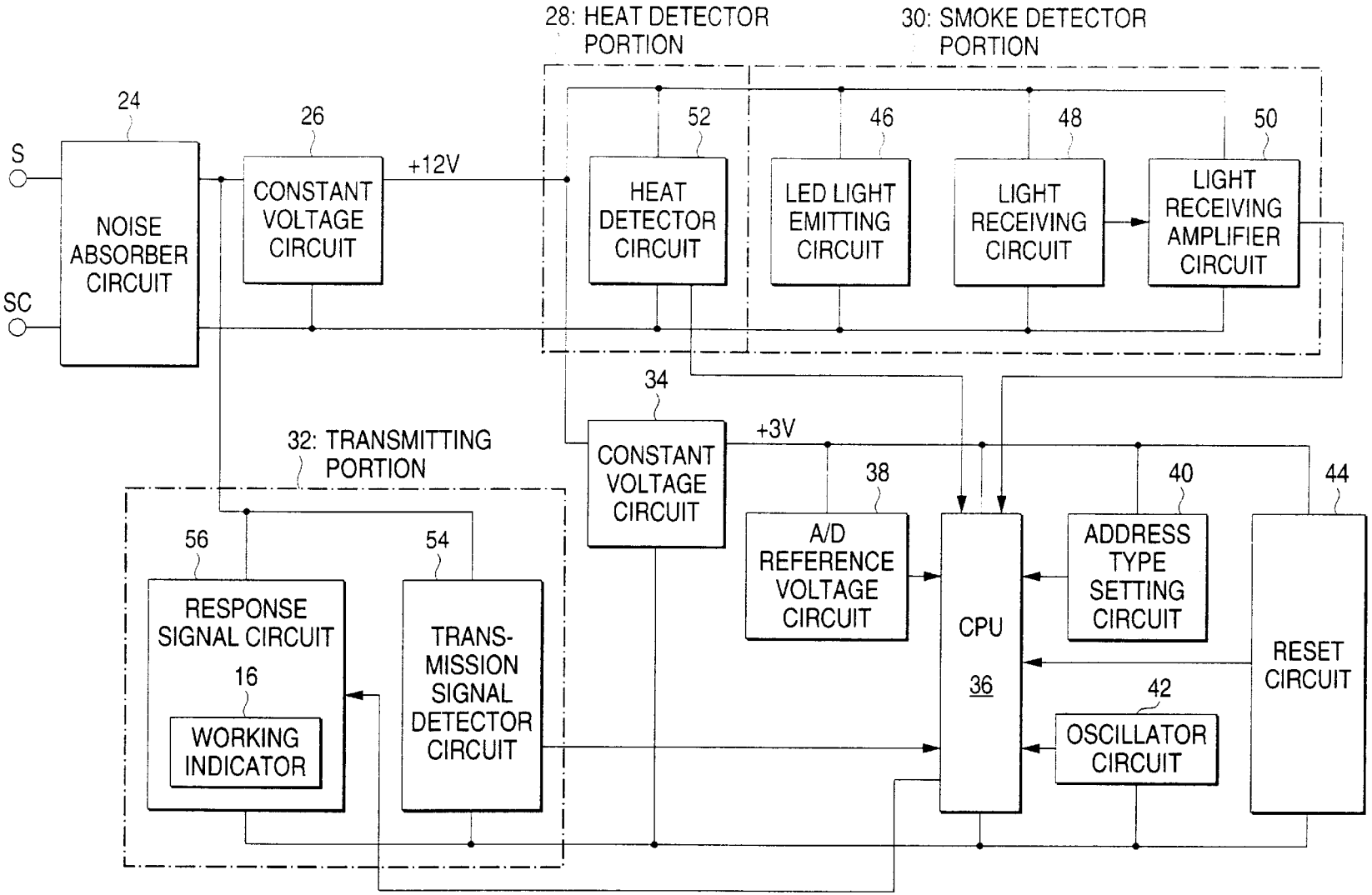
FIG. 3 is a block circuit diagram showing the fire sensor shown in FIG. 1.

FIG. 3 is a block circuit diagram showing internal circuits of the fire sensor according to the present invention. In FIG. 3, following to terminals S, SC which are connected to the receiver side, a noise absorber circuit 24 and a constant voltage circuit 26 are provided in sequence. The constant voltage circuit 26 can stabilize a power supply voltage supplied from the receiver side into +12 V, for example, and then output a stabilized voltage. A eat detector portion 28 and a smoke detector portion 30 are provided at the succeeding stage of the constant voltage circuit 26.

A transmitting portion 32 is provided at the preceding stage of the constant voltage circuit 26. A constant voltage circuit 34 is provided subsequently to the transmitting portion 32. The constant voltage circuit 34 receives a power supply voltage of +12 V from the constant voltage circuit 26 and then generates a stabilized constant voltage output of +3 V. A CPU 36 is provided after the constant voltage circuit 34. An A/D reference voltage circuit 38, an address type setting circuit. 40, an oscillator circuit 42, and a reset circuit 44 are connected to the CPU 36.

A heat detector circuit 52 is provided in the heat detector portion 28. As shown in a block circuit diagram of FIG. 4, the heat detector circuit 52 includes an external thermistor 58, an external temperature detector circuit 60, an internal thermistor 62, and an internal temperature detector circuit 64. The external thermistor 58 is positioned in the sensor cover 18 provided onto the head 10 in FIG. 1 in the condition that it can be exposed to an outer air. Thus, the external thermistor 58 can generate change in its resistance value in response to an external temperature.

The external temperature detector circuit 60 can convert change in the resistance value of the external thermistor 58 into an external temperature signal which corresponds to an external temperature To, and then output the external temperature signal to the CPU 36. The internal thermistor 62 is positioned in the inside of the head 10 in FIG. 1 not to be exposed to the outer air. Thus, the internal thermistor 62 can generate change in its resistance value in response to an internal temperature. According to the change in the resistance value of the internal thermistor 62, the internal temperature detector circuit 64 can output an internal temperature signal, which corresponds to an internal temperature Ti, to the CPU 36 in FIG. 3.

Referring to FIG. 3 once again, the smoke detector portion 30 comprises an LED light emitting circuit 46, a light receiving circuit 48, and a light receiving amplifier circuit 50. The LED light emitting circuit 46 can operate to gene:ate a light from an LED as a light source intermittently. In order to generate the light, the LED may be driven in synchronism with a calling signal, which is supplied during a constant period from the receiver to the terminals S, SC, otherwise the LED may be driven by a frequency-divided pulse, which is divided from a clock pulse from the oscillator circuit 42, at a constant time interval.

The light receiving circuit 48 can receive a scattered light and then convert it into an electric signal. Such scattered light is generated when the light emitted from the LED being driven by the LED light emitting circuit 46 is scattered by the smoke flowing into the sensor in the fire. A weak light signal received by the light receiving circuit 48 is amplified by the light receiving amplifier circuit 50, and then output to the CPJ 36 as a smoke signal.

The transmitting portion 32 has a transmission signal detector circuit 54 and a response signal circuit 56. A working indicator 16 is included in the response signal circuit 56. The transmission signal detector circuit 54 can receive a request-to-send signal supplied to the terminals S, SC from the receiver (not shown), and then transmit the request-to-send signal to the CPU 36. This request-to-send signal from the receiver is formatted by a command, an address, and a check sum.

When the CPU 36 receives the request-to-send signal from the receiver via the transmission signal detector circuit 54, such CPU 36 can correct the smoke signal S, which is input from the light receiving amplifier circuit 50, by using a correction factor K based on the external temperature To from the heat detector circuit 52 and temperature difference $\Delta T(=To-Ti)$ between the external temperature To and the internal temperature Ti, and then output the corrected smoke data S to the receiver side via the response signal circuit 56.

The working indicator 16 is driven by the response signal circuit 56 to be turned on when the CPU 36 executes a reply operation for the receiver. Also, the working indicator 16 may be turned on according to the fire detecting signal supplied from the receiver when the fire is detected based on the smoke data S being transmitted to the receiver. In other words,the working indicator 16 is flashed at the time of transmission of the response signal, and the working indicator 16 is turned on when the fire sensor receives the fire detecting signal from the receiver.

The request-to-send signal for the fire sensor from receiver is transmitted as change in the voltage over a pair of signal lines being connected to the terminals S, SC. On the other hand, the response signal from the transmitting portion 32 of the fire sensor is transmitted as a current mode in which a current is flown between the signal lines.

The A/D reference voltage circuit 38 can output reference voltages for A/D converters 66, 68, 70 which are provided in the CPU 36. The A/D converters 66, 68, 70 can convert the external temperature To signal and the internal temperature Ti signal, both are supplied from the heat detector circuit 52, and the smoke signal S, which is supplied from the light receiving amplifier circuit 50, into digital signals respectively.

The address type setting circuit 40 can set sensor addresses in the CPU 36 and also decides types of the sensor.

The fire sensor of the present invention outputs the smoke signal S to the receiver in a normal mode. The oscillator circuit 42 can oscillate a clock pulse to operate the CPU 36. When the power supply voltage which is supplied from the constant voltage circuit 34 to the CPU 36 rises up to a specified voltage in turning on the power supply on the receiver side, the reset circuit 44 can perform initial reset of the CPU 36 by outputting a reset signal to the CPU 36.

Figure 5:
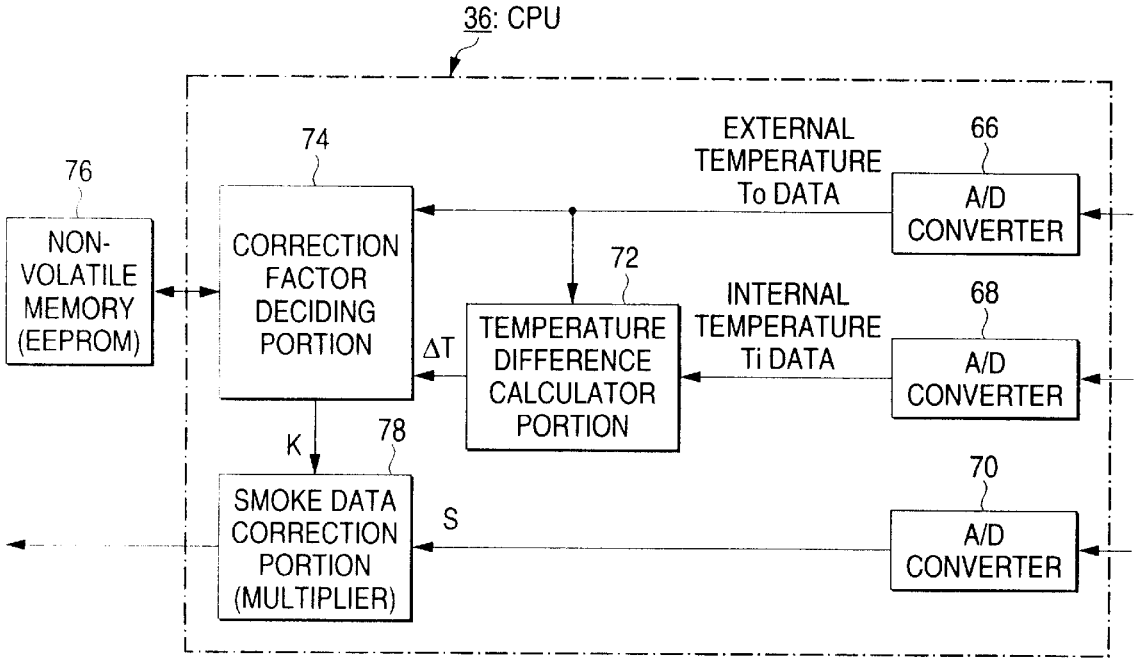
FIG. 5 is a functional block diagram showing a fire sensor according to a first embodiment of the present invention which can be implemented by using a CPU shown in FIG. 3.

FIG. 5 is a functional block diagram showing a fire detecting method of the present invention which can be implemented under program control by the CPU 36 shown in FIG. 3. In FIG. 5, as its functions, the CPU 36 includes the A/D converters 66, 68, 70, a temperature difference calculator portion 72, a correction factor deciding portion 74, and a smoke data correction portion 78 using a multiplier.

Figure 4:
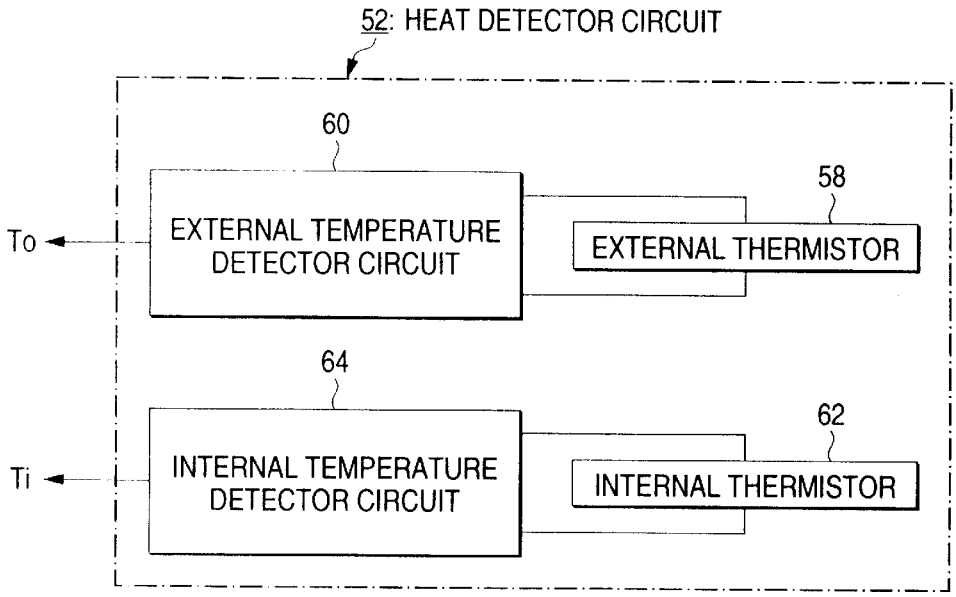
FIG. 4 is a block circuit diagram showing a heat detector circuit shown in FIG.3 and having an external thermistor and an internal thermistor.

The A/D converter 66 can convert the e)ternal temperature To signal, which is supplied from the external temperature detector circuit 60 provided in the heat detector circuit 52 in FIG.4, into a digital external temperature To data and then fetches the data. The A/D converter 68 can A/D-convert the internal temperature Ti signal, which is supplied from the internal temperature detector circuit 64 provided in the heat detector circuit 52 in FIG. 4, into an internal temperature Ti data and then fetches the data. In addition, the A/D converter 70 can convert the smoke signal, which is supplied from the light receiving amplifier circuit 50 provided in the smoke detector portion 30 in FIG. 3, into a digital smoke data S and then fetches the data.

The temperature difference calculator portion 72 can calculate a difference between the external temperature To data fetched by the A/D converter 66 and the internal temperature Ti data fetched by the A/D converter 68 as temperature difference ΔT, and then output the difference to the correction factor deciding portion 74. This temperature difference ΔT represents a rate of temperature rise when the fire sensor receives the hot air flow by the fire.

Based on both the external temperature To data and the temperature difference ΔT, the correction factor deciding portion 74 can decide the correction factor K which is employed to correct the smoke data S fetched by the A/D converter 70. This correction factor K can be saved in advance in the nonvolatile memory 76 based on two temperature conditions of the external temperature To data and the temperature difference ΔT. An address; of the nonvolatile memory 76 in which the corresponding correction factor K based on the external temperature To data derived at that time and the temperature difference ΔT is stored is detected. Then, the corresponding correction factor K is read out according to the designation of the nonvolatile memory 76 by the address and then is output to the smoke data correction portion 78.

In this manner, the correction factor K is directly fetched from the nonvolatile memory 76 into the CPU 36 in FIG.5. However, there may be employed the method in which the data which are in connection with the correction factor K are transferred once from the nonvolatile memory 76 to a RAM (not shown) of the CPU 36 upon turning the power supply on and then a value in the RAM is read out. In this case, an advantage that an access time is not needed can be achieved.

The smoke data correction portion 78 can output smoke data S corrected by multiplying the smoke data S, which are fetched by the A/D converter 70, by the correction factor K, which is output from the correction factor deciding portion 74. In other words, the smoke data correction portion 78 carries out the correction $$S=K\times S$$

and then outputs such smoke data S.

FIGS. 6A and 6B show correction factors K for the smoke data as table information, based on the external temperature To data and the temperature difference ΔT in the present invention. Such table information can be accomplished by the correction factor deciding portion 74 and the nonvolatile memory 76 in FIG. 5.

In FIG. 6A, the column of the table shows the external temperature To (° C.). In this embodiment, the column of the table is divided into six temperature ranges, i.e., below 40.0° C., 40.0° C.≦To<50.0° C., 50.0° C.≦To<60.0° C., 60.0° C.≦To<70.0° C., 70.0° C.≦To<80° C., and over 80° C.

The row of the table shows the temperature difference ΔT (° C.). The row of the table is divided into four temperature ranges, i.e., below 5.5° C., 5.5° C.≦ΔT<13.0° C., 13.0° C.≦ΔT<20.5° C., and over 20.5° C. In respective cells of the table which are partitioned by six temperature ranges of the external temperature To and four temperature ranges of the temperature difference ΔT, numerical values of the correction factor K for the smoke data S are set previously, as shown in FIG. 6A.

The correction factor K has values ranging from 1.0 to 1.6 at maximum, for example. Where the correction factor K=1.0 means that no correction is effected. Accordingly, assume that the correction factor K=1.0 means no correction, the table shown in FIG. 6A can be given as a table shown in FIG. 6B. Based on information in the table shown in FIG. 6B, the correction factor K is decided in the present embodiment as follows.

If the external temperature To is below 40.0° C., the correction is not carried out at all, no matter which cell the temperature difference ΔT belongs to. Also, if the temperature difference ΔT is below 5.5° C., the correction is not carried out at all, no matter which temperature range the external temperature To belongs to. In other words, in the ranges in which no correction is carried out, the fire sensor of the present invention operates as a smoke detector which does not correct the smoke data S and then outputs them as they are.

In contrast, in respective ranges wherein the external temperature To is over 40.0° C. and the temperature difference ΔT is over 5.5° C., the correction factor K which corrects the smoke data so as to increase the smoke detection sensitivity is set. More particularly, in the range of the external temperature To of 40.0° C.≦To<50.0° C., the correction factor K=1.1 if the range of the temperature difference ΔT is 5.5° C.≦ΔT<13.0° C., the correction factor K=1.2 if the range of the temperature difference ΔT is 13.0° C.≦ΔT<20.5° C., and the correction factor K=1.3 if the range of the temperature difference ΔT is over 20.5° C.

Then, in the range of the external temperature To of 50.0° C. ≦To<60.0° C., the correction factor K is set to 1.2, 1.3, and 1.4 respectively when the temperature difference ΔT is 5.50° C.≦ΔT<13.0° C., 13.0° C.≦ΔT<20.5° C., and over 20.5° C. Values of the correction factor K are incremented rather than the case where the preceding external temperature To is 40.0° C.≦To<50.0° C.

Then, in the range of the external temperature To of 60.0° C.≦To<70.0° C., the correction factor K is set to 1.3, 1.4, and 1.5 respectively when the temperature difference ΔT is 5.5° C.≦ΔT<13.0° C., 13.0° C.≦ΔT<20.5° C., and over 20.5° C. The higher values of the correction factor K than those assigned to the preceding external temperature To are set.

Then, in the range of the external temperature To of 70.0° C. ≦To<80.0° C., no correction is made since the correction factor K is set to 1.0 when the temperature difference ΔT is 5.5° C.≦ΔT <13.0° C. Similarly, the correction factor K is set to 1.4 and 1.5 respectively when the temperature difference ΔT is 13.0° C.≦ΔT <20.5° C., and over 20.5° C. Then, in the range of the external temperature To of over 80.0° C., no correction is also made since the correction factor K is set to 1.0 when the temperature difference ΔT is 5.5° C.≦ΔT<13.0° C. Similarly, the correction factor K is set to 1.5 and 1.6 respectively when the temperature difference ΔT is 13.0° C.≦ΔT<20.5° C., and over 20.5° C.

The reason for that no correction is made when the external temperature To is 70.0° C.≦To<80.0° C. and over 80.0° C. respectively and the temperature difference ΔT is 5.5° C.≦ΔT<13.0° C. can be given as follows. That is, the condition in which the external temperature To is high like 70.0° C. or more but the temperature difference ΔT is relatively small like 5.5° C.≦ΔT<13.0° C. corresponds to the temperature circumstance which is caused by heat sources other than the fire. In such case, the correction of the smoke data S is not made.

This condition corresponds to the case where, for example, the fire sensor directly receives the heat radiation or the hot air flow from the space heater. Thus, the external temperature To is high like 70.0° C. or more but the rate of temperature rise is not so increased high unlike the fire. As a result, in order to prevent the non-fire alarm which is generated by correcting the smoke data to increase the smoke detection sensitivity, no correction is made.

More particularly, decision of the correction factors K which are specified by two parameters, i.e., the external temperature To and the temperature difference ΔT, shown in FIG. 6B can be achieved by using an address table and stored data in the nonvolatile memory shown in FIG. 7. FIG. 7A is the address table of the nonvolatile memory 76.

In the address table shown in FIG. 7A, addresses of the nonvolatile memory 76 given in FIG. 7B are stored in the cells, which are specified by the same temperature ranges as the external temperature To and the temperature difference ΔT shown in FIG. 6B, except for the no correction cells. For example, addresses 28, 29, 30; 31, . . . ; 39, 40 are stored in sequence from the upper left corner in the row direction every column. In this case, the nonvolatile memory 76 stores 16-bit binary data consisting of 8-bit correction factors and 8-bit temperature difference ranges in respective addresses.

In correspondence to the address table shown in FIG. 7A, data indicating the correction factors K=1.1, 1.2, 1.3, . . . , 1.5, 1.6 and the ranges of the temperature difference ΔT defined in FIG. 6B are stored respectively in areas of the addresses 28 to 40 of the nonvolatile memory 76 shown in FIG. 7B. Here, for example, as the data indicating the ranges of the temperature difference ΔT, values 6, 13, and 21 are employed to correspond to 5.5° C.≦ΔT<13.0° C., 13.0° C. ≦ΔT<20.5° C., and over 20.5° C. respectively.

Actually the correction factors K=1.1 to 1.6 stored in the nonvolatile memory 76 shown in FIG. 7B are stored as the 8-bit binary data. FIG. 7C shows the actually used correction factors K stored in the nonvolatile memory 76. In this case, the correction factor K=1.0 is represented by the 8-bit binary data "10000000", i.e., "128" in a decimal system. Therefore, the correction factors K=1.1 to 1.6 shown in FIG. 7B are stored as the 8-bit binary data which correspond to the correction factors "141, 154, 166, . . . , 192, 205" in the decimal system.

For addressing of the nonvolatile memory 76 in FIG. 7C based on the external temperature To and the temperature difference ΔT in FIG. 7A, the address table shown in FIG. 7A may be provided in the correction factor deciding portion 74 in FIG. 5. However, in this embodiment, address values are described in the program to designate the addresses corresponding to the external temperature To. Such program is prepared for the CPU 36 which can achieve a function of the correction factor deciding portion 74. Preferably, since an access time can be reduced, the data should be transmitted from the EEPROM to the RAM at the time of turning-on of the power supply and then supplied from the RAM to the CPU.

Figure 8:
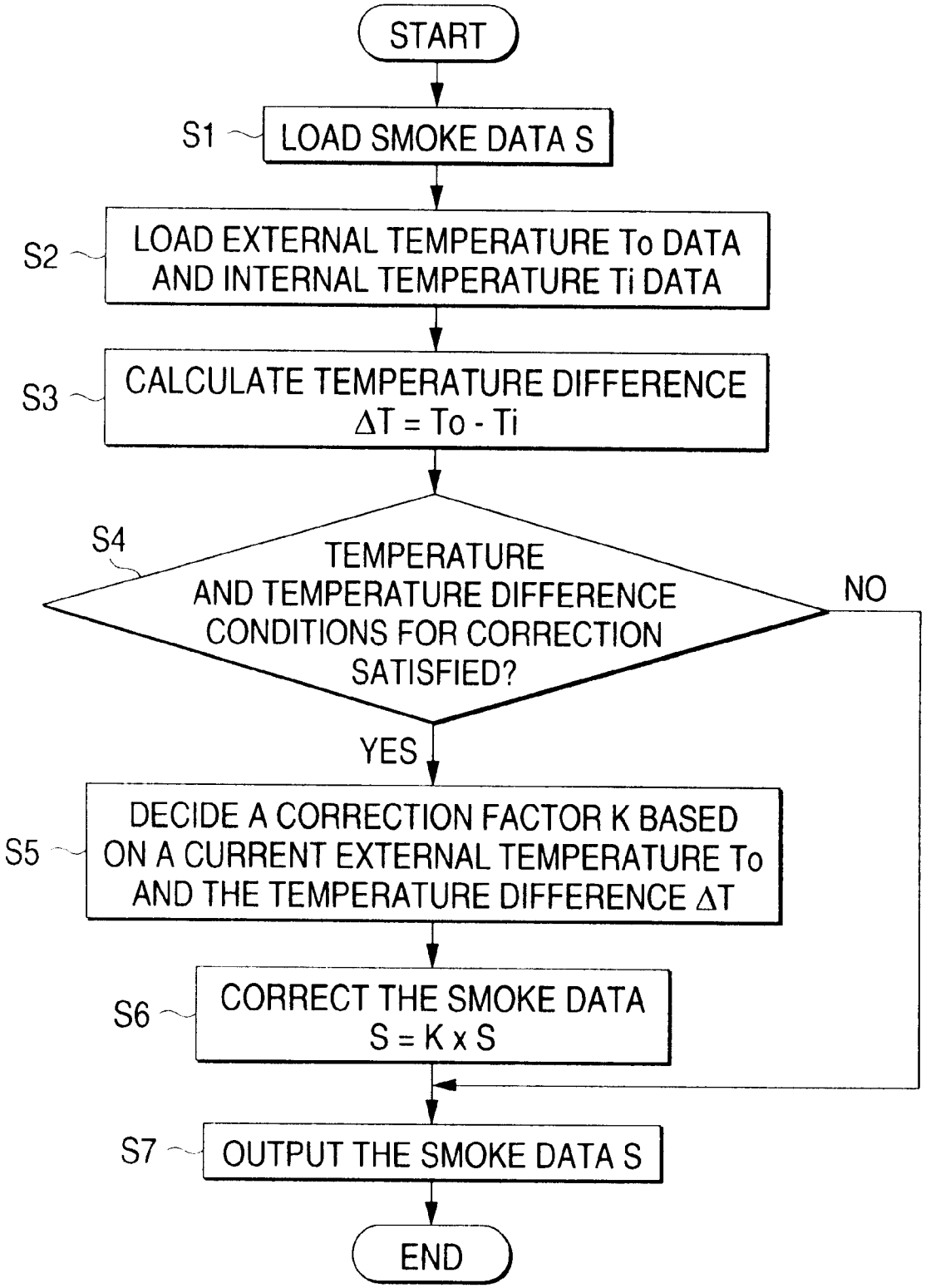
FIG. 8 is a flowchart for explaining fire detection process in FIG. 5.

FIG. 8 is a flowchart for explaining fire detection process in the first embodiment of the present invention by the CPU 36 in FIG. 5. This fire detection process is repeated every constant process period based on an oscillation clock from the oscillator circuit 42 to the CPU 36 in FIG. 3.

First, in step S1, the smoke data S which is converted into digital data by the A/D converter 70 is loaded. Then, in step S2, the external temperature To and the internal temperature Ti are loaded from the A/D converters 66, 68 respectively. Then, in step S3, the temperature difference ΔT is calculated as ΔT=To−Ti by the temperature difference calculator portion 72. Then, the process goes to step S4 where it is decided by the correction factor deciding portion 74 whether or not conditions for the external temperature To and the temperature difference ΔT to correct the smoke data are satisfied.

More particularly, the address corresponding to the temperature range, in which the external temperature To is contained at that time, can be decided in the program indicating the contents of the address table in FIG. 7A, and then the data of the correction factor K and the temperature difference ΔT can be read out from the nonvolatile memory 76. At this time, for example, if the external temperature To belongs to 13.0° C.≦ΔT<20.5° C., addresses 28, 29, 30 in FIG. 7B are designated and then three data are read out from the nonvolatile memory 76. Then, values 6, 13, 21 indicating the ranges of the temperature difference ΔT in the three read data are compared with the temperature difference ΔT at that time, and then the correction factor K in the corresponding range of the temperature difference ΔT is decided (step S5).

Subsequently, in step S6, the smoke data correction portion 78 can correct the smoke data S=K×S by multiplying the smoke data S being fetched from the A/D converter 70 by the decided correction factor K. Finally, in step S7, the corrected smoke data S is output.

On the contrary, in step S4, unless the conditions for the external temperature To and the temperature difference ΔT to correct the smoke data are satisfied, the processes in step S5 and S6 are skipped and then the smoke data S fetched from the A/D converter 70 is output as they are in step S7. More particularly, because the address of the nonvolatile memory 76 cannot be obtained by the correction factor deciding portion 74, the correction by the smoke data correction portion 78 is not performed and then the smoke data S fetched from the A/D converter 70 are output as they are.

In this manner, the correction factor K, which is increased larger if the external temperature To becomes higher and also the temperature difference ΔT indicating the rate of temperature rise becomes larger, can be decided based on the external temperature To at that time and the temperature difference ΔT indicating the rate of temperature rise, and then the smoke data can be corrected to enhance the smoke detection sensitivity. Therefore, even when the fire is caused like a flaming fire which seldom produces the smoke and rapidly increases the temperature, such flaming fire can be early detected from the smoke data without fail by increasing the smoke detection sensitivity.

In contrast, in the normal condition such that the fire sensor receives directly the hot air flow and the heat radiation from the space heater, the external temperature To is high but the temperature difference ΔT is small and also the temperature rise seldom appears. Therefore, in this case, the non-fire alarm can be prevented firmly by applying no correction to the smoke data.

Figure 9:
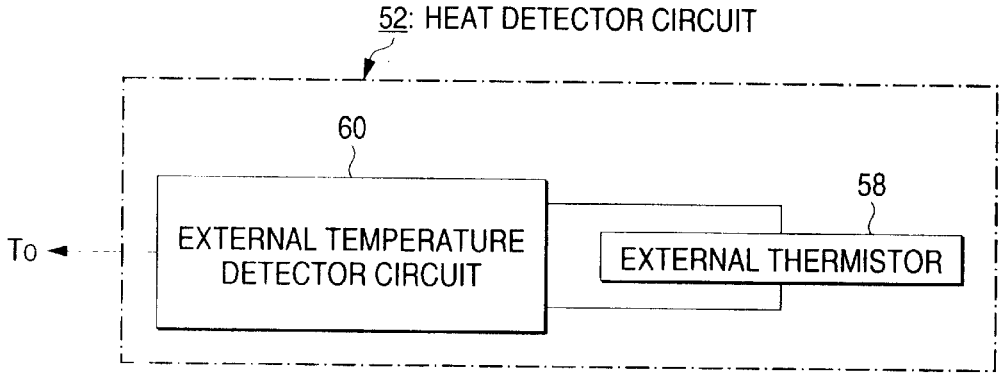
FIG. 9 is a block circuit diagram showing a heat detector circuit shown in FIG. 3 and having an external thermistor only.

FIG. 9 is a block circuit diagram showing a heat detector circuit 52 provided in the heat detector portion 28 in FIG. 3 according to a second embodiment of the present invention. In the heat detector circuit 52 in the second embodiment of the present invention, only the external thermistor 58 is provided. The external temperature detector circuit 60 can output change in the resistance value of the external thermistor 58 due to the external temperature To to the CPU 36 as the external temperature To signal which is changed in response to the external temperature To.

Figure 10:
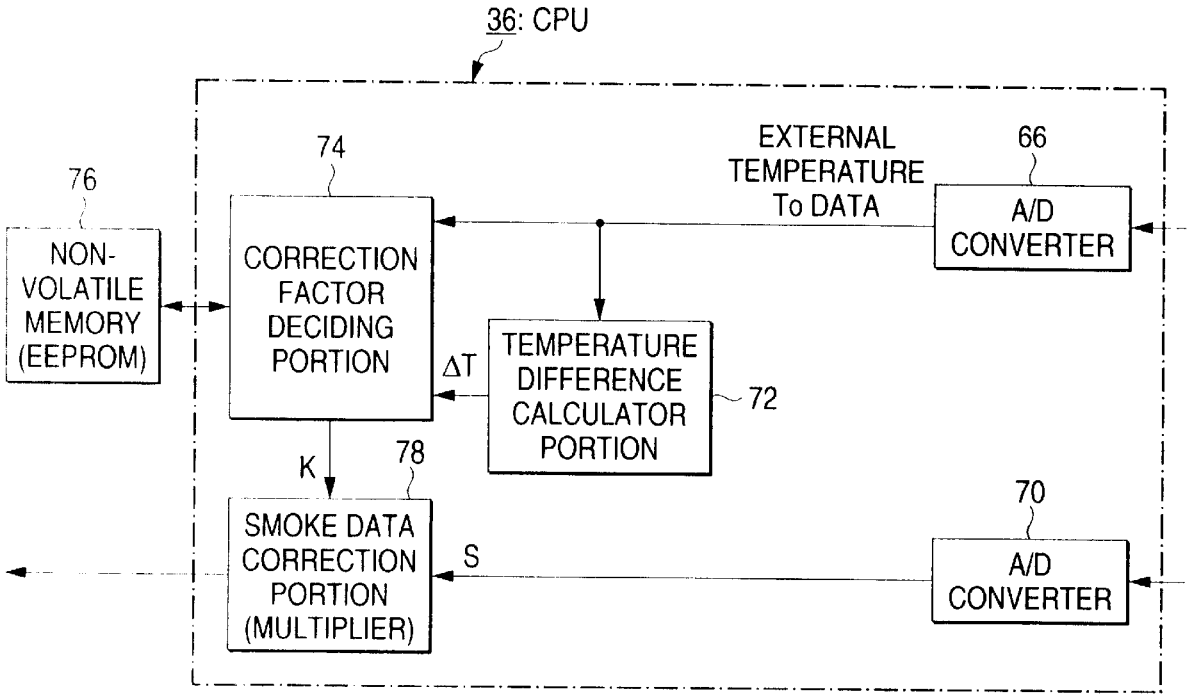
FIG. 10 is a functional block diagram showing a fire sensor according to a second embodiment of the present invention, which can be implemented by using the CPU shown in FIG. 3.

FIG. 10 is a functional block diagram of the CPU 36 as a second embodiment of the present invention, which can correct the smoke detection sensitivity based on the external temperature To signal from the heat detector circuit shown in FIG. 9. In the second embodiment, the external temperature To signal from the external thermistor provided in the heat detector circuit 52 in FIG. 9 and the smoke signal S from the light receiving amplifier circuit 50 provided in the smoke detector portion 30 in FIG. 3 are input into the CPU 36. However, unlike the first embodiment, the internal temperature Ti signal which is detected by the internal thermistor is not input.

The A/D converter 66 can receive the external temperature To every constant period, and then supply it to the temperature difference calculator portion 80 as a digital external temperature To. The temperature difference calculator portion 80 calculate a pseudo output (reference temperature) of the temperature sensor with a larger time constant (this can be regarded as a sensor internal temperature). The temperature difference ΔT indicating the rate of temperature rise caused due to the fire is then calculated based on a difference between the external temperature To data and the reference temperature.

As another method, the temperature data values may be stored over a constant time in advance and then the rate of temperature rise may be calculated by dividing a difference between the data values by a time interval.

The correction factor deciding portion 74, the nonvolatile memory 76, and the smoke data correction portion 78 are similar to those in the first embodiment shown in FIG. 5. For example, the address is decided based on the external temperature To and the temperature difference ΔT in the address table in FIG. 7A, and then the correction factor K is decided by reading it from the nonvolatile memory 76 having the contents shown in FIG. 7C according to the decided address.

Figure 11:
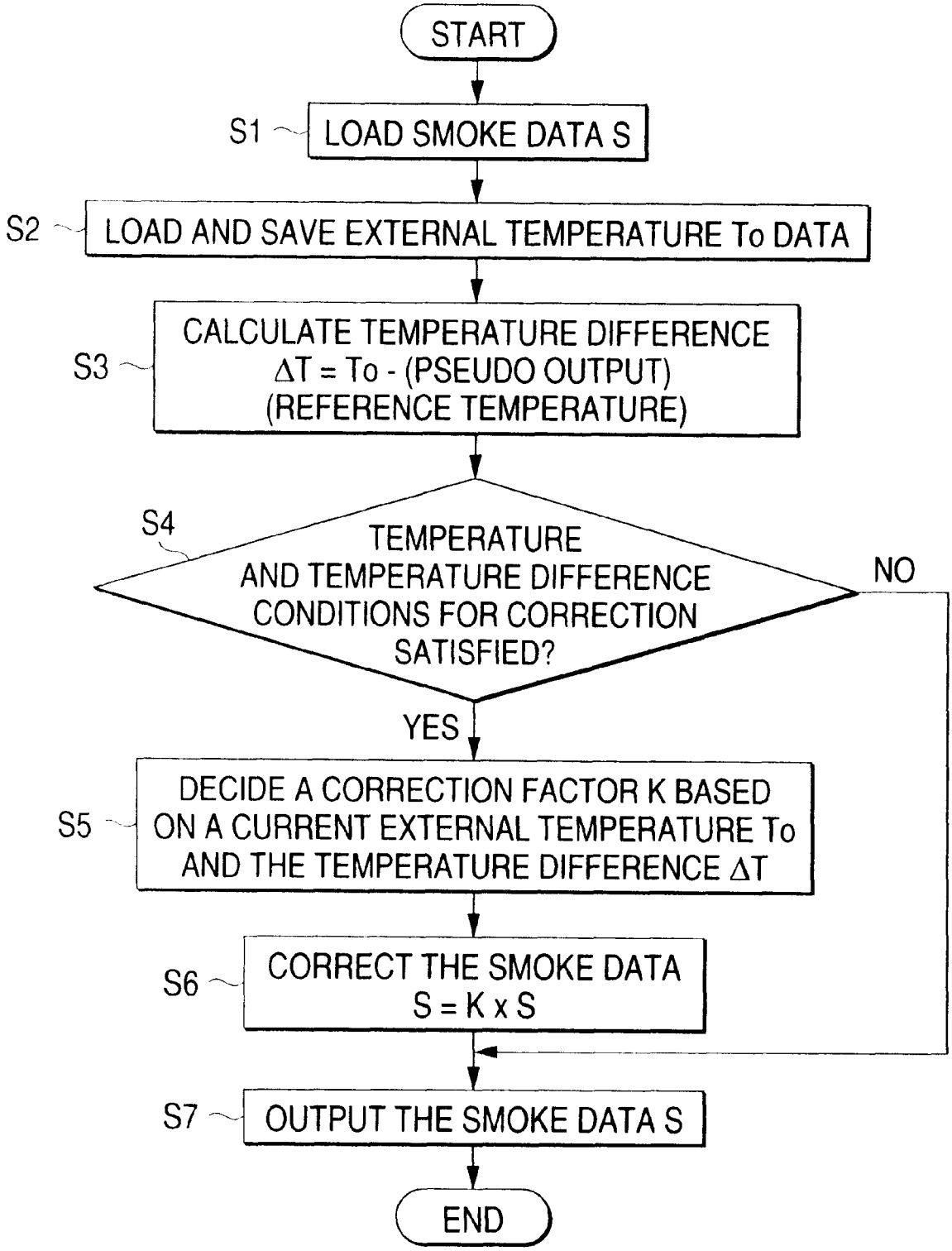
FIG. 11 is a flowchart for explaining fire detection process in FIG. 10.

FIG. 11 is a flowchart for explaining fire detection process according to the second embodiment of the present invention, which is shown by a functional block diagram of the CPU 6 in FIG. 10. In the fire detection process of the second embodiment, the smoke data S is loaded in step S1, then the external temperature To is loaded and saved in step S2, and then the temperature difference calculator portion 80 calculates the temperature difference ΔT data as a difference between a pseudo output (reference temperature), which is regarded as the internal temperature of the sensor, and the external temperature To in step S3.

In turn, it is checked in step S4 whether or not the conditions for the external temperature To and the temperature difference ΔT to correction the smoke data are satisfied. If the conditions are satisfied in step S4, the correction factor K is decided based on the current external temperature To and the temperature difference ΔT in step S5. Then, the smoke data S is corrected as S=K×S by multiplying the smoke data S by the correction factor K in step S6. Then, corrected smoke data S is output in step S7. In contrast, unless the conditions for the external temperature To and the temperature difference ΔT to correction the smoke data are satisfied in step S4, processes in steps S5 and S6 are skipped and then the smoke data S are output as they are in step S7.

In the second embodiment in FIG. 10, if the external temperature To is high and the rate of temperature rise is large, the higher correction factor is decided based on two parameters, i.e., the external temperature To at that time and the temperature difference ΔT indicating the rate of temperature rise, and thus the smoke data are corrected so as to increase the smoke detection sensitivity. Therefore, even if the flaming fire in which the smoke is less generated and the temperature is rapidly increased is caused, the fire can be detected early without fail by correcting the smoke data.

In the situation that the fire sensor receives directly heat from the space heater with no generation of the smoke, the correction of the smoke data is not carried out since the temperature is high but the rate of temperature rise is small, so that the non-fire alarm issued by the space heater, etc. can be prevented surely.

In the above embodiment, decision of the correction factor K which is employed to increase the smoke detection sensitivity based on two parameters of the external temperature and the temperature difference is not limited to the values of the correction factor decided by two temperature ranges in FIG. 6. The correction factor K may be decided appropriately within the range satisfying the condition that, if the external temperature is higher and the rate of temperature rise is larger, the correction factor must be decided to have a larger value. Of course, It this case, no correction is made in the ranges which have the causes other than the fire since the correction is not needed in such ranges.

Also, in the above embodiment, the correction factor K is changed in the range of K=1.1 to 1.6. However, appropriate values of the correction factor K to exceed 1.0 may be set as the case may be. In addition, if the value smaller than 1 is set as the correction factor K, the non-fire alarm issued due to the smoke can be prevented further surely.

Also, in the present invention, the classification is not limited to the temperature ranges of the external temperature To and the temperature difference ΔT shown in FIG. 6.

However, the larger or smaller temperature ranges may be employed to have the smaller or larger division number if necessary. In addition, the numerical values per se may be varied.

As described above, according to the present invention, both early detection of the fire and prevention of the non-fire alarm can be achieved at the same time by executing correction of the smoke detecting characteristic using both the current external temperature and the rate of temperature rise.

Specifically the fire which has not been detected only by the smoke, for example, the flaming fire in which the smoke is less produced but the temperature is increased rapidly, can be detected without fail according to the smoke detection data being corrected by the heat data.

In addition, in the normal circumstance in which the external temperature is high but the rate of temperature rise is small, e.g., if the hot air flow or the heat generated by the space heating directly blows to the fire sensor, the non-f ire alarm which is generated by the smoke produced by the causes other than the fire, the steam generated in cooking, etc. can be prevented surely since no correction of the smoke detection is made.

What is claimed is:

1. A fire sensor comprising:

a smoke detecting portion for detecting a smoke signal which changes in response to a smoke density to output it;

an external temperature detecting portion for detecting an external temperature of the sensor to output it;

a temperature difference calculating portion for calculating temperature difference, which indicates a rate of temperature rise when the sensor receives heat generated by a fire, between the external temperature and the internal temperature;

a correction factor deciding portion for deciding a correction factor for the smoke signal based on the external temperature and the temperature difference; and a smoke signal correcting portion for correcting the smoke signal by multiplying the smoke signal by the correction factor.

2. A fire sensor according to claim 1, further comprising an internal temperature detecting portion for detecting an internal temperature of the sensor to output it.

3. A fire sensor according to claim 1, wherein the temperature difference calculating portion calculates temperature difference, which indicates a rate of temperature rise when the sensor receives heat generated by a fire, between the external temperature and a pseudo output (reference temperature) which is regarded as an internal temperature of the sensor.

4. A fire sensor according to claim 1, wherein the correction factor deciding portion divides the external temperature and the temperature difference into a plurality of temperature ranges each having a predetermined temperature width respectively, then previously sets the correction factor to each temperature range of the temperature difference so as to increase substantially in proportion to an increase of the temperature difference if the external temperature belongs to a same temperature range, then previously sets the correction factor to each temperature range of the external temperature so as to increase substantially in proportion to rise of the external temperature if the temperature difference belongs to a same temperature range, and then decides a previously set correction factor based on the temperature range to which the external temperature detected by the external temperature detecting portion belongs and the temperature range to which the temperature difference calculated by the temperature difference calculating portion belongs.

5. A fire sensor according to claim 4, wherein the correction factor deciding portion varies the correction factor substantially by changing the temperature range of the external temperature and/or the temperature range of the temperature difference while fixing the previously set correction factor itself, otherwise varies the correction factor itself while fixing the temperature range of the external temperature and the temperature range of the temperature difference.

6. A fire sensor according to claim 4, wherein the correction factor deciding portion decides the correction factor of 1.0 to output raw data of the smoke signal by the smoke signal correcting portion if the external temperature is below a first predetermined temperature, if the temperature difference is below a first predetermined temperature difference, or if the external temperature is more than a second predetermined temperature and the temperature difference is less than a second predetermined temperature difference.

7. A fire sensor according to claim 5, wherein the correction factor deciding portion has a nonvolatile memory which stores corresponding values of the correction factor to addresses being specified by the temperature range of the external temperature and the temperature range of the temperature difference, and decides the correction factor by reading the correction factor from the nonvolatile memory by using an address which is specified by the temperature range to which the external temperature detected by the external temperature detecting portion belongs and the temperature range to which the temperature difference calculated by the temperature difference calculating portion belongs.

8. A fire sensor according to claim 1, wherein the external temperature detecting portion has a temperature detecting element to be exposed to an outside of the sensor.

9. A fire sensor according to claim 2, wherein the internal temperature detecting portion has the temperature detecting element to be installed in an inside of the sensor.

10. A fire sensor according to claim 8, wherein the temperature detecting element comprises a thermistor whose resistance value is changed according to the temperature.

11. A fire sensor according to claim 9, wherein the temperature detecting element comprises a thermistor whose resistance value is changed according to the temperature.

12. A fire sensor according to claim 1, wherein the smoke detecting portion receives a scattered light emitted from a light source and scattered by the smoke, and then outputs the smoke signal which changes in response to the smoke density.

13. A fire sensor according to claim 1, further comprising:

a transmitting portion for transmitting to a receiver the smoke signal which is corrected by the smoke signal correcting portion.

14. A fire sensor according to claim 13, wherein the transmitting portion transmits to the receiver the smoke signal which is corrected by the smoke signal correcting portion based on a transmission request issued from the receiver.

15. A fire detecting method comprising:

a smoke detecting step of detecting a smoke signal which changes in response to a smoke density to output it;

an external temperature detecting step of detecting an external temperature of the sensor to output it;

an internal temperature detecting step of detecting an internal temperature of the sensor to output it;

a temperature difference calculating step of calculating temperature difference between the external temperature, which indicates a rate of temperature rise when the sensor receives heat generated by a fire, and the internal temperature;

a correction factor deciding step of deciding a correction factor for the smoke signal based on the external temperature and the temperature difference; and a smoke signal correcting step of correcting the smoke signal by multiplying the smoke signal by the correction factor.

16. A fire detecting method comprising:

a smoke detecting step of detecting a smoke signal which changes in response to a smoke density to output it;

an external temperature detecting step of detecting an external temperature of the sensor to output it;

a temperature difference calculating step of calculating temperature difference between the external temperature, which indicates a rate of temperature rise when the sensor receives heat generated by a fire, and a pseudo output (reference temperature) which is regarded as an internal temperature of the sensor;

a correction factor deciding step of deciding a correction factor for the smoke signal based on the external temperature and the temperature difference; and a smoke signal correcting step of correcting the smoke signal by multiplying the smoke signal by the correction factor.

* * * * *